United States Patent [19]

Lambert, Jr.

[11] 4,041,690

[45] Aug. 16, 1977

[54] NOVELTY YARN AND METHOD FOR MAKING SAME

[75] Inventor: John Wesley Lambert, Jr., Spartanburg, S.C.

[73] Assignee: Tuscarora Cotton Mill, Mount Pleasant, N.C.

[21] Appl. No.: 629,019

[22] Filed: Nov. 5, 1975

[51] Int. Cl.[2] ..... D02G 3/34; D02G 3/36

[52] U.S. Cl. ..... 57/144; 57/91; 57/140 J; 57/160

[58] Field of Search ..... 57/36, 38.3, 38.4, 90, 57/91, 139, 144, 140 J, 156, 160, 140 BY; 19/238

[56] References Cited

U.S. PATENT DOCUMENTS

| | | | |
|---|---|---|---|
| 196,787 | 11/1877 | Craven | 57/38.3 |
| 574,941 | 1/1897 | Richardson | 57/91 |
| 928,831 | 7/1909 | Wood | 57/139 |
| 1,313,594 | 8/1919 | Hartshorne | 57/139 |
| 3,082,593 | 3/1963 | Rhyne | 57/139 |
| 3,394,541 | 7/1968 | Rhyne | 57/91 |
| 3,447,307 | 6/1969 | Rhyne | 57/139 |
| 3,778,992 | 12/1973 | Rhyne | 57/139 |
| 3,961,471 | 6/1976 | Allen | 57/140 J |

FOREIGN PATENT DOCUMENTS

| | | | |
|---|---|---|---|
| 637,432 | 3/1962 | Italy | 57/91 |
| 47-49452 | 12/1972 | Japan | 57/91 |
| 385,263 | 3/1931 | United Kingdom | 57/38.3 |
| 1,354,107 | 5/1974 | United Kingdom | 57/91 |

*Primary Examiner*—John Petrakes

*Attorney, Agent, or Firm*—Bell, Seltzer, Park & Gibson

[57] ABSTRACT

A novelty yarn comprising a ground strand of spun staple fibers with relatively short varying length and varying size auxiliary strands of staple fibers randomly distributed along the ground strand and spirally twisted therearound. The largest size auxiliary strands have portions thereof formed of such a large number of fibers so arranged spirally around the ground strand that adjacent turns of those portions overlie and substantially shield the underlying ground strand from view. Other intermediate size auxiliary strands are formed of a lesser number of fibers and are so arranged spirally around the ground strand that both the ground strand and the auxiliary strand are exposed to view. Still other smallest size auxiliary strands are formed of such a few number of fibers arranged spirally around the ground strand so as to be barely discernible thereon. The ground strand and the auxiliary strand may be of the same or of differing color characteristics.

19 Claims, 13 Drawing Figures

NOVELTY YARN AND METHOD FOR MAKING SAME

This invention relates to novelty yarns, and more particularly to novelty yarns of the type wherein lengths of auxiliary strands are intertwisted with a ground strand to produce slubs, flakes or other novelty effects.

Various kinds of novelty of slub-type yarns have been formed in the prior art by incorporating auxiliary strands at spaced locations along a primary or ground strand. By way of example, reference may be made to the following U.S. Pat. Nos.: Wood No. 928,831; Horner 2,069,446; Neisler Jr., 2,845,771; Rhyne 3,082,593; 3,394,541, 3,447,307, 3,778,992 and 3,835,639; and Joy 3,310,933.

In the prior novelty or slub-type yarns of which I am aware, the auxiliary strands distributed therein along the yarn generally have a similar appearance and present generally similar novelty effects along the yarn.

It is a primary object of this invention to provide a novelty yarn wherein the auxiliary strands distributed therein are of such varying size and varying length as to achieve a variety of different novelty effects along the yarn.

More particularly, it is an object of this invention to provide a novely yarn wherein certain of the auxiliary strands therein are of a relatively large size and have portions thereof formed of such a large number of fibers so arranged spirally around the ground strand that adjacent turns of the portions overlie and substantially shield the underlying ground strand from view.

In accordance with the invention, the yarn may have other auxiliary strands of an intermediate size distributed therein and formed of a lesser number of fibers and being so arranged spirally around the ground strand that both the ground strand and the auxiliary strand are individually discernible.

A further aspect of the invention involves incorporating still other auxiliary strands of a smaller size in the yarn, with such smaller size auxiliary strands being formed of such a few number of fibers arranged spirally around the ground strand as to be barely discernible thereon.

Pursuant to the invention, the auxiliary strand and the ground strand may be of the same or of differing color characteristics. Further, the ground strand itself may be composed of fibers of differing color characteristics.

In many of the prior methods and machines for making novelty yarns of the type described, wherein auxiliary strands are incorporated therein, some type of pattern mechanism is required to effect distribution of the auxiliary strands in the yarn. The use of pattern mechanisms may result in an undesirable repetitive pattern of distribution of the auxiliary strands in the yarn which may become visible when the yarn is woven or knitted into a fabric.

With the foregoing in mind, it is still another object of this invention to provide a method of making a novelty yarn of the type described wherein the auxiliary strands are distributed along the yarn entirely at random, and are of widely varying size and length.

Some of the objects and features of the invention having been stated, other objects and features will appear as the description proceeds when taken in connection with the accompanying drawings, in which.

Figure 1:
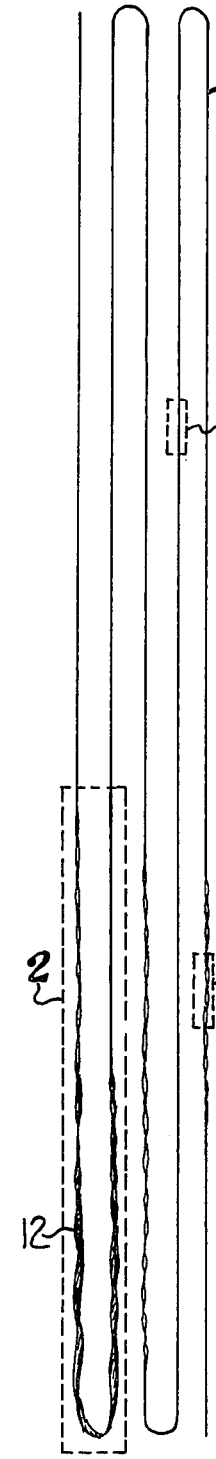
FIG. 1 is a view illustrating a portion of a novelty yarn in accordance with one embodiment of the invention.
Figure 6:
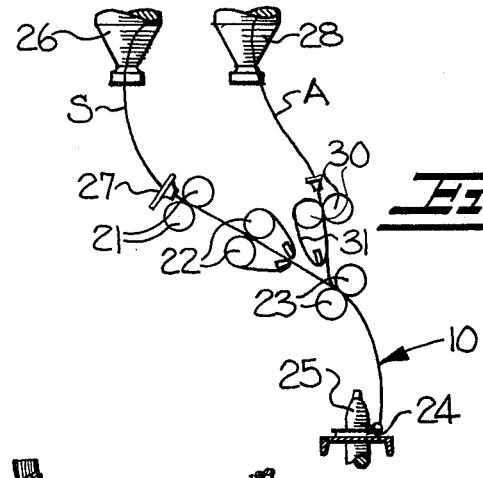
Figure 4:
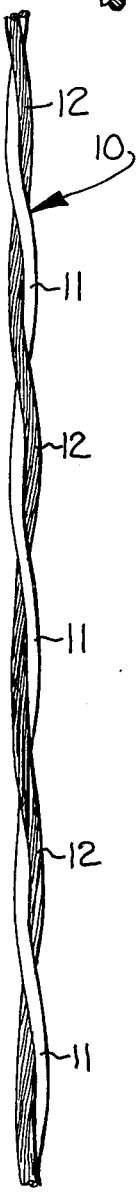
Figure 5:
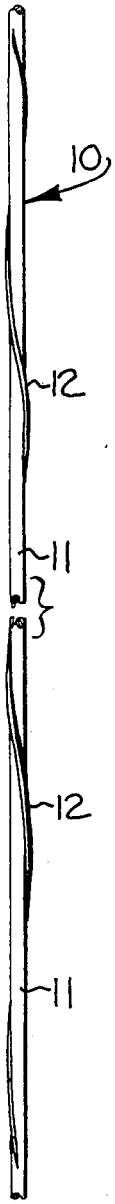
Figures 7, 8, 9, 10, 11, 12, 13:
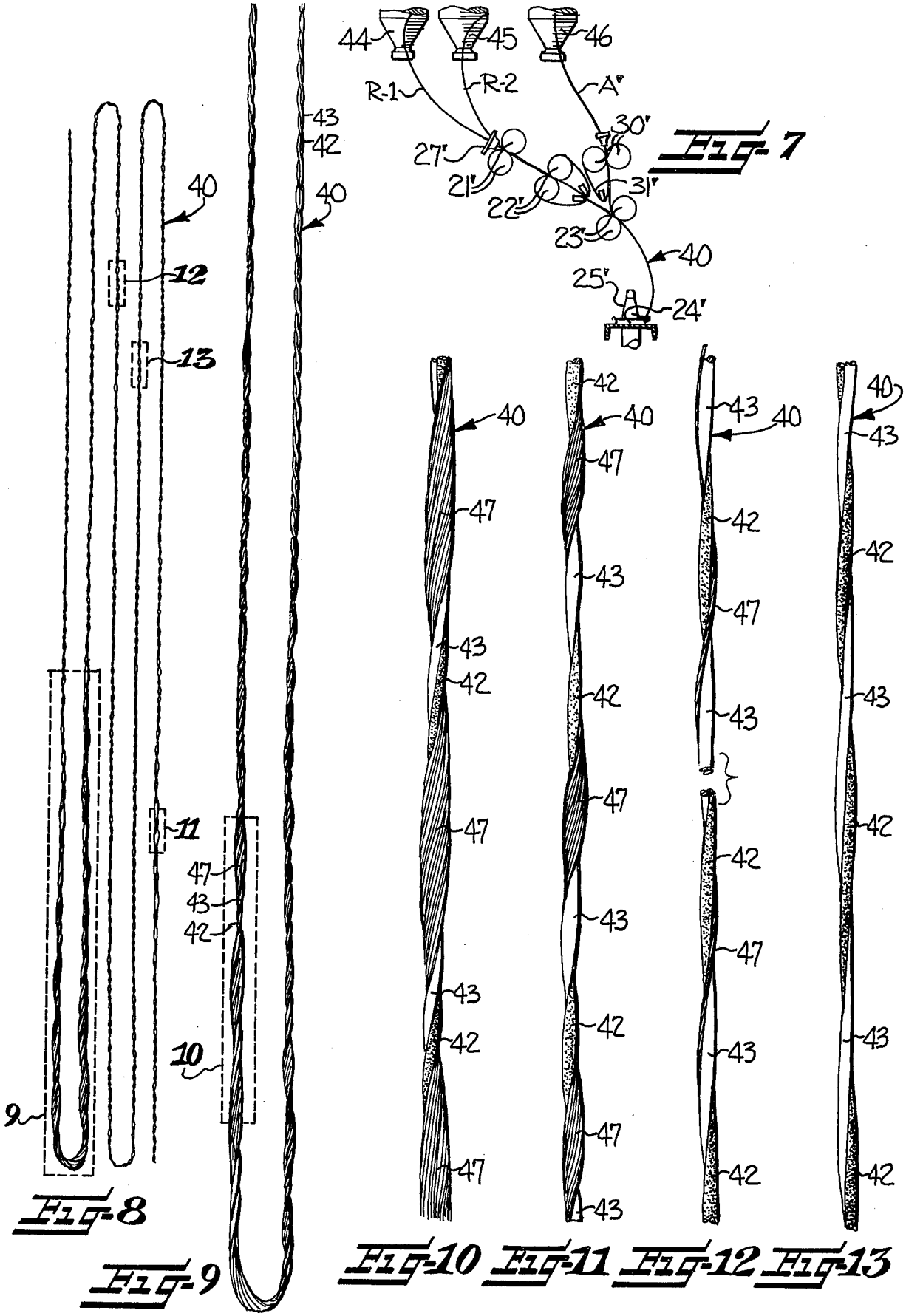

FIGS. 4 and 5 are enlarged detailed views of those portions of the yarb of FIG. 1 within the broken lines 4 and 5, respectively;

FIG. 6 is a schematic view illustrating a spinning apparatus for producing a novelty yarn in accordance with the method of this invention;

FIG. 7 is a schematic view of a spinning apparatus for producing a novelty yarn in accordance with a second embodiment of this invention;

FIG. 8 is a view illustrating a portion of a second type of novelty yarn in accordance with the invention;

FIG. 9 is an enlarged fragmentary detailed view showing that portion of yarn of FIG. 8 within broken lines 9;

FIG. 10 is a greatly enlarged fragmentary detailed view showing that portion of the yarn of FIG. 9 within the broken lines 10; and FIGS. 11 through 13 are enlarged detailed views showing those portions of the yarn of FIG. 8 within the broken lines 11 through 13, respectively.

Referring now more particularly to the drawings, the novelty yarn 10 illustrated is a singles or one-ply yarn comprising an elongate ground strand 11 of spun staple fibers with relatively short varying length and varying size auxiliary strands 12 being spirally twisted around the ground strand. As described in more detail herein, the auxiliary strands 12 are of varying length and of widely varying size and are randomly distributed along the length of the ground strand to produce various novelty effects.

Preferably the auxiliary strands 12 are of a color characteristic differing from the ground strand 11 so that the various novelty effects will be most pronounced. The term "color characteristic" is used herein to refer to the characteristic of the strand or its constituent fibers which results in a difference in the color appearance of the strand. This would include fibers which are of different natural colors or differing light reflectivity, as resulting, for example, from differences in the type of fiber, composition, fiber cross section, etc. This would also include strands whose fibers are different colors as a result of dyeing prior to formation of the novelty yarn. The term would also include fibers with differences in dye affinity and wherein dyeing is performed after formation of the novelty yarn with certain of the fibers of the yarn achieving a color different from other fibers of the yarn. The ground strand and the auxiliary strand may each be of a single color characteristic, as illustrated, or if desired, either one or both may be of multiple color characteristic. It will be understood that all of the strands of the novelty yarn may, if desired, be of the same color characteristic or kind without departing from the broad invention.

Referring now to the novelty yarn 10 illustrated in FIGS. 1 to 5, the ground strand 11 thereof is illustrated by way of example as being white, with the auxiliary strand 12 being a contrasting darker color, for example, red.

Figure 2:
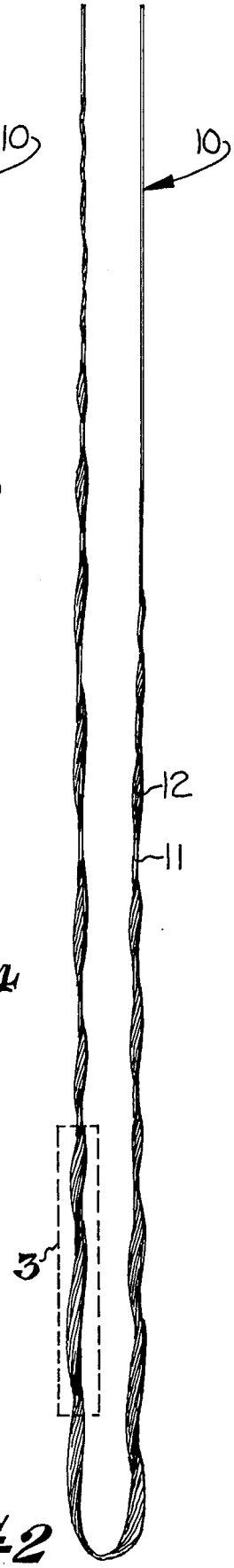
FIG. 2 is an enlarged fragmentary detailed view of that portion of the yarn of FIG. 1 within the broken lines 2.
Figure 3:
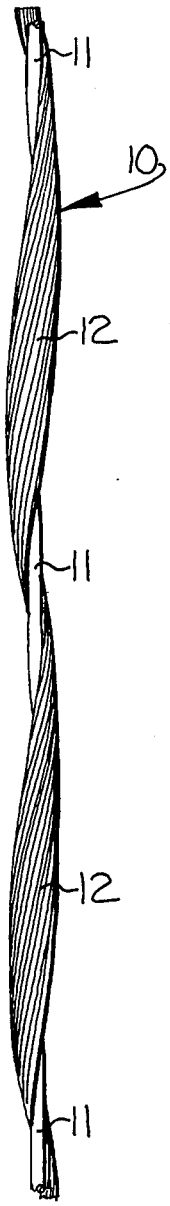
FIG. 3 is a greatly enlarged fragmentary detailed view of that portion of the yarn of FIG. 2 within the broken lines 3.

Referring to the portion of the yarn illustrated in detail in FIG. 2, which shows one of the largest size auxiliary strands incorporated in the novelty yarn, it will be seen that in the medial portion of this auxiliary strand 12, as shown within the broken lines 3 in FIG. 2 and in FIG. 3 at a larger scale, a large number of fibers are so arranged spirally around the ground strand 11 that adjacent turns or windings of the auxiliary strand substantially overlie and shield the underlying ground strand from view. This results in the yarn having the predominant red color appearance of the auxiliary strand in this area. More particularly, it will be seen from FIG. 3 that the fibers of the auxiliary strand in this area are arranged spirally around the ground strand in the form of a ribbon or a relatively flattened band of fibers. Furthermore, the auxiliary strand is tapered or attenuated along its length with the number of fibers therein becoming less and less in the distal portions of the auxiliary strand approaching the terminal ends thereof. The spiral turns of the auxiliary strand in these distal portions are not spaced as closely together as in the medial portion of the strand. Thus, both the ground strand and the auxiliary strand are individually discernible in these areas giving the yarn a multi-color 37 candy stripe" effect in these areas. The large number of fibers in these largest size auxiliary strands, particularly in the medial portions thereof, results in an enlarged thickness portion or "flake" in the yarn further accentuating the color of the surrounding auxiliary strand. Further, the fibers of the auxiliary strands are relatively loosely bound to the underlying ground strand in these areas resulting in increased fuzziness from the fibers of the auxiliary strand.

The portion of the yarn 10 shown within the broken lines 4 of FIG. 1 and in FIG. 4 illustrate the novelty effect resulting from the spiral twisting of an intermediate size auxiliary strand around the ground strand. Like the largest size auxiliary strands, the intermediate size strand is largest adjacent the medial portion thereof and is tapered or feathered in the distal portions of the strand toward the terminal ends thereof.

The intermediate size auxiliary strand 12 of FIG. 4 is arranged spirally around the strand with adjacent turns spaced apart from one another so that both the ground strand and the auxiliary strand are individually discernible giving the yarn a multi-color effect in these areas. The auxiliary strand 12 illustrated is spirally arranged with adjacent turns thereof overlying and shielding about half or less of the ground strand from view. As illustrated, the strands are normally arranged as rounded bundles of fibers spirally around the ground strand.

A further novelty effect is achieved in the yarn as a result of the presence of very small size auxiliary strands being arranged spirally around the ground strand. As shown within the broken lines 5 of FIG. 1 and greatly enlarged in FIG. 5, these smallest size auxiliary strands 12 are formed of such a few number of fibers as to be barely discernible in the yarn when viewed without magnification. However, the contrasting color of the red fibers of the auxiliary strand 12 against the white ground strand 11 results in slightly altering the color of the yarn. Thus with the naked eye the yarn in these areas has a slightly pink tint. The number of fibers in these areas is so small that the size of the yarn is not appreciably altered.

The above described varying size auxiliary yarns and the novelty effects resulting therefrom appear entirely at random along the length of the ground strand in no particular order, with each auxiliary strand being spirally arranged around the ground strand in non-overlapping spaced relation with successive auxiliary strands. This completely random distribution and random size of the auxiliary strands is achieved by forming a ground strand of drafted staple fibers in a conventional manner while continuously feeding an auxiliary strand of staple fibers and directing the same into engagement with the ground strand while effecting a random parting of the auxiliary strand to thereby form random relatively short lengths of auxiliary strand randomly distributed along the ground strand. The ground strand and the thus randomly distributed auxiliary strands are twisted and taken up in a conventional manner, as by a ring spinning frame. The random parting or breaking of the continuously fed auxiliary strand is accomplished by feeding the same at a substantially slower rate that it is being taken away along the ground strand so that auxiliary strand is stretched and randomly broken at weak places in the strand.

The novelty yarn of the present invention may be produced on any conventional spinning machine suitably modified as described herein. For example, referring to FIG. 6, the apparatus may include the conventional type of drafting system found on ring spinning frames including a set of three paired drafting rolls 21, 22, 23 and a twisting mechanism including a spinning ring 24 and a bobbin 25 upon which the yarn is wound. A strand of fibrous material S, normally in the form of a roving, is fed from a suitable supply source or package 26 through a guide 27 and between the rear drafting rolls 21. The roving S is drafted in the conventional manner to form a single continuous ground strand 11 of drafted staple fibers delivered from the front rolls 23 of the drafting zone.

An auxiliary roving A is fed from a suitable supply source or package 28 and between an additional pair of feed rolls 30 provided adjacent to the front rolls 23 of the conventional drafting system. Rolls 30 rotate continuously but at a rate less than the rate of rotation of rolls 23 so that drafting of the auxiliary roving A occurs between the rolls 30 and the front rolls 23. The rate of feed rolls 30 as compared to the front rolls 23 is such that the auxiliary roving is drafted so much as to be broken or parted randomly and periodically at weak points in the auxiliary strand. Thus, relatively short random length auxiliary strands 12 are formed and randomly distributed along the ground strand 11. Suitable guide means in the form of apron 31 is provided to direct the broken end of the auxiliary roving A into engagement with the ground strand 11 behind the delivery rolls 23 each time a break or parting of the auixliary roving A occurs.

The size of the auxiliary strands 12 may be controlled to some extent by the amount of draft imparted to roving A between the rolls 30 and the front rolls 23 due to their relative speed of rotation. Thus, it will be appreciated that if a very high draft is imparted to the roving A, the breaks therein will be more frequent and the resulting random length auxiliary strands 12 will be shorter and smaller, while if the draft is reduced, longer and somewhat larger auxiliary strands 12 will be formed. At any given amount of draft, however, the parting or breaking of the roving A will occur randomly due to the random non-uniformities in the roving to thereby provide random length auxiliary strands 12 of varying sizes ranging from very small to relatively large. The attenuated, feathered or tapered portions at each end of the auxiliary strand are a result of the roving A being drafted to the point of breaking.

If desired, the rate of rotation of the rolls 30 may be varied during the spinning operation to provide a wider variety of sizes of auxiliary strands and thereby achieve a further variance in the type of novelty effects achieved in the yarn.

In accordance with an alternate embodiment of the invention, the ground strand may be formed of drafted staple fibers from a plurality of different strands, which may be of similar or differing color characteristics. Referring to FIG. 7, it will be seen that a novely yarn 40 is spun by forming a ground strand from two rovings R1 and R2 of differing color charcteristics, so that the ground strand has portions 42 formed from fibers of a relatively dark color and portions 43 formed from fibers of a light color. The apparatus for forming the novelty yarn in accordance with this form of the invention is very similar to that described with respect to FIG. 6, and reference numerals corresponding to those in FIG. 6, with prime notation added, are employed for corresponding parts to avoid repetitive description. Referring more particularly to FIG. 7, the differing color rovings R1 and R2 are fed from respective supply packages 44 and 45 through a drafting zone defined by a set of three paired drafting rolls 21', 22', 23' and to a spinning ring 24'.

An auxiliary roving A' of a color characteristic differing from the rovings R1 and R2, is fed from a supply package 46 between feed rolls 30' and into the delivery end of the drafting zone behind front rolls 23'. With the auxiliary roving A' being randomly parted by drafting, as described above, to form relatively short auxiliary strands 47 of varying length and of varying size.

The various size auxiliary strands 47 are distributed and arranged along the ground strand in a similar arrangement as in the previously described embodiment. Thus, one of the largest size auxiliary strands incorporated in the yarn is illustrated in FIGS. 9 and 10 and within the broken lines 9 in FIG. 8. It will be seen that the auxiliary strand 47 is formed of such a large number of fibers arranged spirally around the ground strand that adjacent turns of the auxiliary strand substantially overlie and shield the underlying ground strand from view with the yarn thus having the predominant color appearance of the auxiliary strand in this area. As in the previous embodiment, the distal portions of the largest size auxiliary strands 47 are smaller than the medial portions thereof and are arranged with adjacent turns spaced apart from one another so that both the auxiliary strand and the underlying ground strand are visible.

Referring to FIG. 8, it will be seen that the auxiliary strands are distributed randomly along the yarn in spaced apart non-overlapping relation. As shown in FIG. 13, the intervening portions of the ground strand have a multi-color appearance resulting from the light color fibers 43 and the dark color fibers 42 being spirally intertwisted to define alternating hands of the light and dark colors along the strand.

A substantial number of the auxiliary strands in the yarn are of an intermediate size similar to the auxiliary strand 47 as shown in FIG. 11 and in the broken lines 11 of FIG. 8. The intermediate size auxiliary strand 47 of FIG. 11 is illustrated as being spirally arranged around the ground strand with adjacent turns thereof overlying and shielding about half or less of the ground strand from view, with both the auxiliary strand and the underlying ground strand thus being discernible. More particularly, it will be seen that both of the contrasting color bands 42 and 43 of the underlying ground strand are visible as well as the surrounding auxiliary strand 47, and the yarn has a multi-color appearance similar to a barber pole.

Also found in the novelty yarn are a number of very small size auxiliary strands which serve to produce a still further novelty effect in the yarn. These smallest size auxiliary strands 47 are formed of such a few fibers as to be barely visible in the yarn, as illustrated in FIG. 12 for example. However the contrasting color of the fibers of the auxiliary strand against the underlying multi-color ground strand results in altering the overall color appearance of the yarn even though the auxiliary fibers are not readily individually discernible.

The novely yarns of this invention, as described above, may be used in a wide variety of fabrics, either as a singles yarn as illustrated, or as a plied yarn when plied with other novely or conventional yarns.

In the drawings and specification there have been set forth preferred embodiments of the invention, and although specific terms are employed, they are used in a generic and descriptive sense only.

That which is claimed is:

1. A novelty yarn comprising a ground strand of spun staple fibers, relatively short varying length and varying size auxiliary strands of staple fibers randomly arranged in spaced relation along the ground strand and being spirally twisted therearound, the largest size auxiliary strands having portions thereof formed of such a large number of fibers and being so arranged spirally around the ground strand that adjacent turns of said portions overlie and substantially shield the underlying ground strand from view, other intermediate size auxiliary strands formed of a lesser number of fibers and being so arranged spirally around the ground strand that both the ground strand and the auxiliary strand are individually discernible, and other smallest size auxiliary strands being formed of such a few number of fibers arranged spirally around the ground strand as to be barely discernible thereon.

2. A novelty yarn according to claim 1 wherein the portions of said largest size auxiliary strands which overlie and substantially shield the underlying ground strand from view are medial portions of the auxiliary strands with distal portions thereof being formed of a lesser number of fibers so arranged spirally around strand that the underlying ground strand is discernible as well as the auxiliary strand.

3. A novelty yarn according to claim 1 wherein said intermediate size auxiliary strands are so arranged spirally around the ground strand that adjacent turns thereof overlie and shield about half or less of the ground strand from view.

4. A novelty yarn according to claim 1 wherein said ground strand is formed of staple fibers of a predetermined color characteristic, and wherein said varying length and varying size auxiliary strands are of a color characteristic differing from said ground strand.

5. A novelty yarn according to claim 1 wherein said ground strand is formed of staple fibers or differing color characteristics intertwisted so as to form alternating bands of the differing color characteristics along the ground strand, and wherein said varying length and varying size auxiliary strands are of a color characteristic differing from the color characteristics of the ground strand.

6. A novelty yarn comprising a ground strand of spun staple fibers, relatively short varying length and varying size auxiliary strands of staple fibers randomly arranged in spaced relation along the ground strand and being spirally twisted around the ground strand, the largest size auxiliary strands having portions thereof formed of a relatively large number of fibers arranged as bands of fibers spirally around the ground strand with adjacent turns of the bands of fibers overlying and substantially shielding the underlying ground strand from view, other intermediate size auxiliary strands being formed of a lesser number of fibers with at least the medial portions thereof being arranged as bundles of fibers spirally around the ground strand with adjacent turns of said portions overlying and shielding about half or less of the ground strand from view, and other smallest size auxiliary strands being formed of such a few number of fibers arranged spirally around the ground strand as to be barely discernible thereon.

7. A novelty yarn according to claim 6 wherein said portions of the largest size auxiliary strands are formed of such a large number of fibers that substantial enlarged thickness portions are defined on the yarn, and wherein said smallest size auxiliary strands are formed of such a few number of fibers that the size of the yarn if not appreciably affected.

8. A novelty yarn comprising a ground strand of a predetermined color characteristic formed of spun staple fibers, relatively short varying length and varying size auxiliary strands of staple fibers of a predetermined color characteristic differing from said ground strand and being randomly arranged in spaced relation along the ground strand and spirally twisted therearound, certain of said auxiliary strands having medial portions thereof formed of such a large number of fibers and being so arranged spirally around the ground strand that adjacent turns of said portions overlie and substantially shield the underlying ground strand from view, distal portions of said certain auxiliary strands being formed of a lesser number of fibers so arranged spirally around the ground strand that the underlying ground strand is discernible as well as the auxiliary strand.

9. A novelty yarn according to claim 8 wherein said ground strand is formed of staple fibers of differing color characteristics intertwisted so as to form alternating bands of the differing color characteristics along the ground strand, and wherein said varying length and varying size auxiliary strands are all of a common color characteristic differing from the color characteristics of the ground strand.

10. A novelty yarn comprising a ground strand of a predetermined color characteristic formed of spun staple fibers, relatively short varying length and varying size auxiliary strands of staple fibers of a predetermined color characteristic differing from said ground and being randomly distributed serially in non-overlapping spaced relation along the ground strand and spirally twisted therearound, certain of said auxiliary strands having medial portions thereof formed of such a large number of fibers so arranged spirally around the ground strand that adjacent turns of said portions overlie and substantially shield the underlying ground strands from view, distal portions of said certain auxiliary strands being formed of a lesser number or fibers so arranged spirally around the ground strand that the underlying ground strand is discernible as well as the auxiliary strand.

11. A novelty yarn comprising a single ground strand of a predetermined color characteristic formed of spun staple fibers, relatively short varying length and varying size auxiliary strands of a predetermined color characteristic differing from said ground strand, said auxiliary strands being formed of spun staple fibers and being randomly distributed in spaced relation along the length of the ground strand and spirally twisted therearound, the largest size auxiliary strands having portions of their length formed of such a large number of fibers so arranged spirally around the ground strand that adjacent turns of said portions overlie and substantially shield the underlying ground strand from view to present to the yarn the predominant color characteristic of the surrounding auxiliary strand, other intermediate size auxiliary strands being formed of a lesser number of fibers so arranged spirally around the ground strand that adjacent turns thereof overlie and substantially shield about half or less of the ground strand from view to present a multi-color appearance to the yarn, and other smallest size auxiliary strands being formed of such a few number of fibers arranged spirally around the ground strand as to be barely discernible thereon but serving to slightly alter the color of the yarn.

12. A novelty yarn according to claim 11 wherein the portions of said largest size auxiliary strands which overlie and substantially shield the ground strand and present to the yarn the predominat color characteristics of the auxiliary strands are medial portions of the auxiliary strands with distal portions thereof being formed of a lesser number of fibers so arranged spirally around the ground strand that the auxiliary strand and ground strand are both discernible to present a multi-color appearance to the yarn.

13. A method of making a novelty yarn having relatively short varying length and varying size auxiliary strands randomly distributed therealong, said method comprising advancing at least one strand of staple fibers into and through a drafting zone and drafting the fibers while continuously forming a single ground strand of drafted staple fibers therefrom and while feeding an auxiliary strand of staple fibers from outside the drafting zone directly into the delivery end of the drafting zone in such a manner as to effect a random parting of the auxiliary strand and thereby form relatively short varying length auxiliary strands randomly distributed along the ground strand, and twisting the ground strand and the randomly distributed auxiliary strands to arrange the auxiliary strands spirally around the ground strand and form a novelty yarn therefrom.

14. A method according to claim 13 wherein said feeding of the auxiliary strand into the delivery end of the drafting zone includes stretching the auxiliary strand so as to effect breaking of the strand at randomly distributed relatively weak places in the strand.

15. A method of making a novelty yarn having a relatively short varying length and varying size auxiliary strands randomly distributed therealong, said method comprising advancing at least one strand of staple fibers into and through a drafting zone and drafting the fibers while continuously forming a single ground strand of drafted staple fibers from outside the drafting zone directly into the delivery end of the drafting zone at a slower rate than the rate of delivery of the ground strand from the drafting zone to effect drafting and random parting of the auxiliary strand and thereby form relatively short varying length auxiliary strands randomly distributed along the ground strand, and twisting the ground strand and the randomly distributed auxiliary strands to arrange the auxiliary strands spirally around the ground strand and form a novelty yarn therefrom.

16. A method of making a novelty yarn having relatively short varying length and varying size auxiliary strands randomly distributed therealong, said method comprising continuously advancing at least one roving into and through the drafting zone of a spinning frame while drafting the fibers thereof and continuously forming a single ground strand of drafted staple fibers, feeding an auxiliary roving through a pair of feed rolls located outside of the drafting zone and directing the auxilary roving directly into the delivery end of the drafting zone and alongside the ground strand being delivered therefrom and while stretching and breaking the auxiliary roving between the feed rolls and the delivery end of the drafting zone to effect a random parting of the auxiliary roving and thereby form relatively short varying length auxiliary strands randomly distributed along the ground strand, and twisting the ground strand and the randomly distributed auxiliary strands to arrange the auxiliary strands spirally around the ground strand and form a novelty yarn therefrom.

17. A method according to claim 16 wherein the feeding of the auxiliary roving is performed continuously by continuous rotation of the feed rolls and the stretching and breaking of the auxiliary roving between the feed rolls and the delivery end of the drafting zone comprises feeding the auxiliary roving through the continuously rotating feed rolls at a rate slower than the rate of delivery of the ground strand from the drafting zone so as to effect drafting and random parting of the auxiliary roving.

18. A method according to claim 17 including varying the rate of feed of the auxiliary roving through the feed rolls so as to vary the amount of drafting of the auxiliary roving and thereby achieve a wider variation in length and size of the auxiliary strands.

19. A method of making a novelty yarn comprising continuously advancing a plurality of rovings of differing color characteristics into and through a drafting zone and drafting the fibers thereof while continuously forming therefrom a single ground strand of drafted staple fibers of differing color characteristic differing from said ground strand from outside the drafting zone directly into the delivery end of the drafting zone in such a manner as to effect a random parting of the auxiliary roving and thereby form relatively short varying length and varying size auxiliary strands randomly distributed along the ground strand, and twisting the ground strand and the randomly distributed auxiliary strands to arrange the auxiliary strands spirally around the ground strand and form a novelty yarn therefrom having a multi-colored ground strand with varying length and varying size auxiliary strands of a color characteristic differing from the ground strand and being randomly distributed along the ground strand and spirally twisted therearound.

* * * * *

UNITED STATES PATENT AND TRADEMARK OFFICE

CERTIFICATE OF CORRECTION

PATENT NO. : 4,041,690

DATED : August 16, 1977

INVENTOR(S) : John Wesley Lambert

It is certified that error appears in the above-identified patent and that said Letters Patent are hereby corrected as shown below:

Column 1, Line 10, "of" 2nd. occ. should be -- or -- Col.2,line 11, "yarb" should be --yarn--. Column 3, Line 24, after "multi-color" delete "37"; same column, Line 35, "illustrate" should be --illustrates--. Column 4, Line 19, "that" should be --than--; same line, after "along" insert --with--; Line 53, "auixliary" should be --auxiliary--; Line 66 after "non-uniformities" insert --present--. Column 5, Line 59, "hands" should be --bands--. Column 6, Line 49, CLAIM 2, after "around" insert --the ground--. Column 7, Line 26, CLAIM 7, "if" should be --is--; Line 56, CLAIM 10, after "ground" insert --strand--. Column 8, Line 28, CLAIM 12, "predominat" should be --predominant--; Line 56, CLAIM 15, delete the second occurrence of "a".

Column 9, Line 14, CLAIM 16, "auxilary" should be --auxiliary--. Column 10, Line 15, CLAIM 19, "characteristic" should be --characteristics--
Column 3, line 24, "candy" should read -- "candy --.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*